US005303761A

United States Patent [19]

Flessner et al.

[11] Patent Number: 5,303,761

[45] Date of Patent: Apr. 19, 1994

[54] DIE CASTING USING CASTING SALT CORES

[75] Inventors: Thomas F. Flessner, Olympia; Christopher S. Marr, Tacoma, both of Wash.

[73] Assignee: Puget Corporation, Tacoma, Wash.

[21] Appl. No.: 27,186

[22] Filed: Mar. 5, 1993

[51] Int. Cl.[5] ..... B22C 9/10; B22D 29/00

[52] U.S. Cl. ..... 164/15; 164/28; 164/522; 164/132; 264/328.2; 264/328.16

[58] Field of Search ..... 164/15, 28, 369, 522, 164/47, 132; 264/328.16, 328.2

[56] References Cited

U.S. PATENT DOCUMENTS 5,182,117 1/1993 Ozawa et al. ..... 264/328.16

FOREIGN PATENT DOCUMENTS 60-166433 8/1985 Japan ..... 264/328.16

*Primary Examiner*—Kuang Y. Lin

*Attorney, Agent, or Firm*—Robert L. Harrington

[57] ABSTRACT

A process of providing a disposable core for use in die casting processes. A salt material is molten and cast into a core of a desired configuration under exacting conditions. The fluidity of the molten salt is controlled enabling casting the salt material into a core by die casting methods. The die casting method provides a core with a high surface finish and strength. The core is evenly cooled subsequent to it being cast and is maintained at an elevated temperature to maintain its surface finish and structural integrity. The cast core is inserted into the dies of a metal die casting machine to facilitate casting a metal product having internal forms not otherwise attainable. The core is removed from the metal product by simply dissolving and flushing the core out of the casting. The salt material may be reclaimed by a de-salination process for further use.

5 Claims, 3 Drawing Sheets

DIE CASTING USING CASTING SALT CORES

FIELD OF THE INVENTION

This invention relates to the production of cores used for producing internal passages in a die casting process.

BACKGROUND OF THE INVENTION

Internal passages are not commonly provided in products produced by a die casting process. Casting an internal passage requires the use of a core produced from a material that can be removed from the cast product without damaging the product. Sand and foam are common materials used for making cores. Sand is removed by demolishing it and foam is removed by burning. However, neither is considered suitable for die casting. The die casting process subjects the cores to high pressures during the fill process that are typically beyond that which can be withstood by sand and foam cores. Sand cores are also difficult to demolish and the destructions of foam produces toxic contaminants that are environmentally undesirable.

Accordingly, die casting is most commonly achieved without the production of internal passages or cavities. Products produced by die casting that have internal passages require follow-up processes. More often such products are produced by methods other than die casting.

An alternative material was developed some years ago as having properties desirable for producing cores for casting. This material has a salt base (soda ash or perhaps more accurately an ionic compound) that is dissolvable in water but in a dry state can be provided in powder-like form. The dry powder form can be melted into a liquid or molten state, poured into a mold and cooled to a solid state. That is, the core is produced by "casting" the desired core shape and the core produced thereby is in turn used for the casting of a metal product requiring internal passages. Such a core can be inserted into a casting mold, and following the casting process, it can be simply washed out of the product to leave the internal passages or cavities. Such a material is available from Park Chemical Company of Detroit, Mich. and the material is known as Aluminum Casting Salt. Hereafter this material is often referred to simply as casting salt but includes all materials having similar properties, e.g., an ionic compound that can be molded into a solid state and washed away with water.

The problem with this material is that the casting salt cores previously produced with any degree of success have been produced by the known method of gravity flow casting. These have been found to be too fragile for use in die casting. Whereas the die casting process as compared to gravity flow casting is known to produce a stronger casting, that has not been the case for producing cores of casting salt. Prior attempts to produce cores from casting salt have resulted in disaster. The liquid molten casting salt has such a low viscosity that the material cannot be contained in the die casting molds. When the material is converted to its molten state and injected into a casting mold under the required high pressures, the material simply blows or spits out the vent holes (or out the seams of the mold in a natural venting process). Thus, the use of casting salt for making cores for die casting has been extremely limited. It is believed that there is a single application where such cores are die cast but under extremely unsatisfactory conditions. It is understood that in this application the molten casting salt spits or blows out of the seams and the process is both wasteful and messy and requires special preparation and cautious handling.

BRIEF SUMMARY OF THE INVENTION

There are two major problems involved when trying to produce cores by the method of die casting. The first has been identified, i.e., the molten casting salt is so fluid (has such low viscosity) that the molds will not contain it. When injected into the casting mold in the typical die casting process, it blows through the tightest joints between the casting mold halves. The second is the property of low heat conduction, i.e., it insulates rather than transfers heat. When a mold is filled with the molten salt material, on outer skin initially solidifies due to the transfer of heat to the casting walls, and the solidified skin inhibits heat transfer out of the core interior. The interior thus cools slowly and if the core is removed from the mold while the core interior is still in the molten state, the core will likely explode. Cooling the core interior to the solid state in the typical die casting process takes far too long for efficient commercial exploitation.

The problem of blowing or spitting is primarily solved by adding a step to the typical process of die casting. Whereas in the typical molding process molten metal is ladled from vats contained in furnaces directly into the shot sleeve of the die casting machine, in the present process the molten casting salt is pre-cooled. That is, the material is ladled from the furnace vats where the casting salt is necessarily maintained at a temperature that exceeds its melting temperature, and before being added to the shot sleeve, it is cooled to precisely the temperature where it starts to solidify (referred to herein as the liquidus temperature). At this point, the casting salt becomes more viscous as it begins to make the transformation to a solid state. It is then that the material is transferred into the shot sleeve and injected into the dies of the casting machine.

Whereas three different stages are commonly used for injecting the molten material into the die mold (slow shot, fast shot, and intensifying pressure), the intensifying pressure is eliminated and the fast shot velocity is reduced to further alleviate the likelihood of blowing and also to avoid turbulence. The gates through which the liquid or molten casting salt is driven into the die cavity are also modified to avoid turbulence and produce what is referred to as solid front filling. The release agent that is applied to the interior sides of the mold to assist separation can contaminate the casting salt core and is applied minimally to alleviate the likelihood of such contamination.

The problem of the skin forming around the core interior is avoided by applying a controlled heat to the casting wall. This slows the solidification of the outer skin but conversely allows more rapid cooling and thus solidification of the core interior. Thus, the slowed cooling of the core exterior allows a more rapid solidification of the total core and significantly speeds production.

The casting salt core formed as generally described is a far stronger core than is produced by gravity flow casting and will resist premature destruction in the die casting of metal products. However, the core retains this property at its maximum only so long as the temperature of the core is maintained at a high temperature, e.g., 600 degrees Fahrenheit, and also so long as it is not subjected to moisture. Dropping the temperature, e.g., to below 200 degrees Fahrenheit will result in dramatic shrinking and cracking whereas moisture will cause the core to deteriorate. However, when maintained properly, the core has a smooth glossy exterior texture and produces a finished interior passageway or cavity in a metal casting that requires no follow-up processing. Furthermore, the casting salt is readily removed simply by washing. The salt goes into solution and simply flows out of the casting. The solution thereby produced from the dissolved casting salt can be desalinated to convert the casting salt back to its dry form and then reused if desired.

These and other advantages will become apparent to those skilled in the art upon reference to the following detailed description and the drawings referred to therein.

DESCRIPTION OF THE PREFERRED EMBODIMENT

Figure 1:
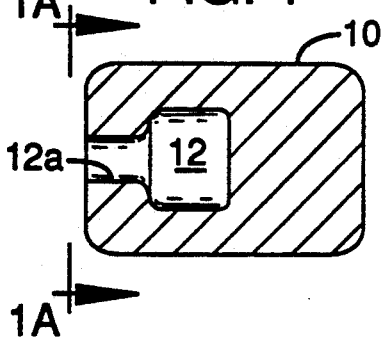
FIG. 1 is a schematic illustration in cross section of a product such as may be produced by die casting in accordance with this invention.
Figure 1A:
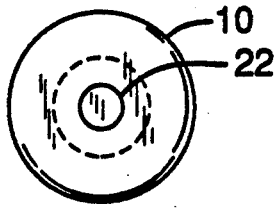
FIG. 1*a* is a view taken on view lines 1*a*—1*a* of FIG. 1.

FIGS. 1 and 1*a* schematically illustrate a product 10 having an internal cavity 12. In order to produce this product 10 by the die casting process (See FIG. 2), a mold 14 is created having a cavity 16 that is the shape of the product 10. A core 18 is positioned in the cavity 16 that conforms to the internal cavity 12 of the product 10.

Figure 2:
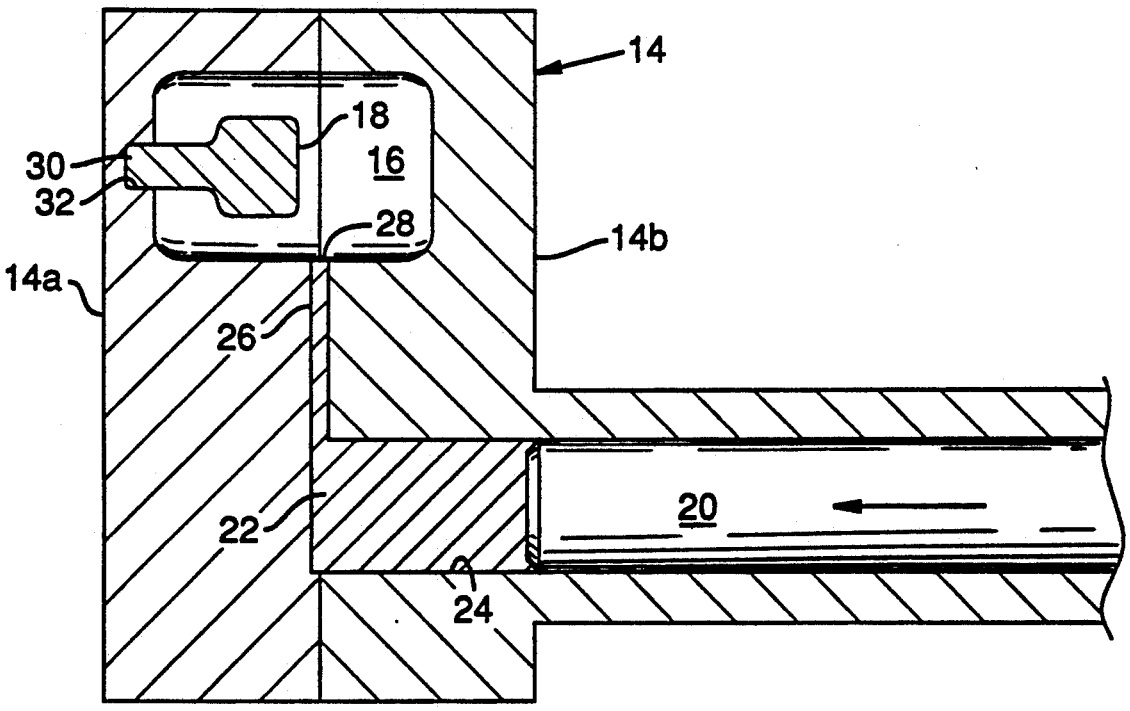
FIG. 2 schematically illustrates a die casting machine for die casting the product of FIG. 1.

FIG. 2 illustrates a condition of die casting wherein a piston 20 has pushed a quantity of molten metal 22, e.g., aluminum, through a shot sleeve 24 and into a passage 26 where it is about to pass through a gate opening 28 into the cavity 16. The next stage of the casting process includes the further driving of the piston 20 down the shot sleeve 24 to fill the cavity 16 with the molten aluminum and thereby form the product 10. When the aluminum solidifies, the two halves 14*a* and 14*b* of the die mold are separated (the product 10 slides out of die half 14*b*). The product 10 is then removed from the die half 14*a*, e.g, using ejecting pins common to the industry but which are not shown in the figures.

Obviously product 10 cannot be removed from the half 14*a* unless core 18 remains with product 10 and also separates from die half 14*a*. This core 18 is a separate part of the mold that is seated at end 30 into a seat depression 32 formed in die half 14*a*. Removal of core 18 from cavity 12 is the next step. Because the core 18 will not fit through the opening 12*a* of cavity 12, core 18 must be destroyed without destroying the product 10.

The core 18 must be sufficiently tough to withstand the high pressures that are created when molten aluminum 22 is shot through the gate 28 and impacts the core, and it must also be readily destructible so as to allow removal of the core 18 from the product 10 following extraction of the product 10 and core 18 from the die halves 14*a*, 14*b*.

A material exists that can be cast into a desired solid shape and then destroyed by flushing with water. The product is an ionic compound, i.e., it is primarily a soda ash, and is available in powder form known as Aluminum Casting Salt. The core 18 is produced from such a casting salt. The core produced from the casting salt is itself produced by the method of die casting as illustrated in FIG. 3.

Figure 3:
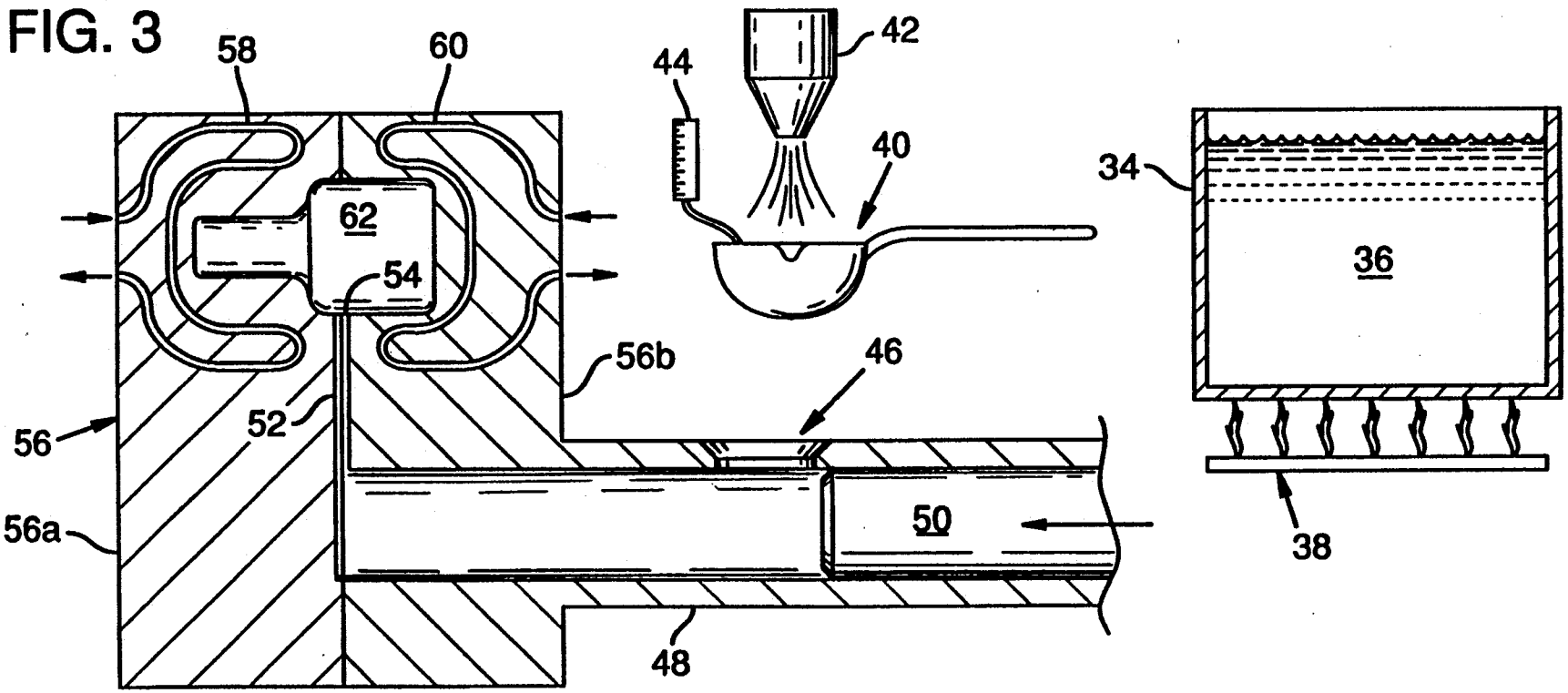
FIG. 3 schematically illustrates a die casting machine for die casting a core used in the die casting machine of FIG. 1.

The die cast machine of FIG. 3 is similar to that of FIG. 2 as is the process employed, but with several significant and important differences.

A vat 34 contains a quantity of molten casting salt 36 to which heat is applied (e.g., in a furnace 38) to maintain the casting salt at a sufficiently high temperature to remain in the molten state. In a specific example provided hereafter, that temperature is about 1,320 degrees Fahrenheit. The molten casting salt is ladled out of the vat 34 as represented in FIG. 3 by ladle 40. At this point, the molten salt 36 contained in the ladle 40 is cooled, represented by a blower 42. The temperature of the molten salt is monitored as represented by thermometer 44. Once the desired temperature is reached, e.g., 1,255 degrees Fahrenheit, the molten salt has reached its solidus stage (the stage of transference to a solid and the stage where as a fluid it is most viscous). It is then ready to be poured into the shot sleeve. (In actual practice, monitoring may simply be a specified dwell time as all other conditions are controlled and it will be known how long it takes to cool the molten salt to the desired temperature.)

At the precise point of having reached the solidus temperature, the molten salt is poured through opening 46 into the shot sleeve 48. The plunger 50 then pushes the molten salt through the sleeve 48 to fill the passageway 52. This is the same position as illustrated for the aluminum casting process of FIG. 2. Again, a difference from that of the process of FIG. 2 is the gate 54 which is designed to allow the molten salt to flow through the gate rather than being sprayed through the gate as is typical of aluminum die casting. The fill process is nevertheless very rapid and is referred to as solid front filling.

The second major significant difference is the provision for heating the casting mold of the core casting machine 56. Illustrated in FIG. 3 are channels 58, 60 in the die halves 56*a*, 56*b* through which hot oil is circulated to control the cooling process of the molten casting salt upon entry into the cavity 62 of the mold 56.

Figure 4:
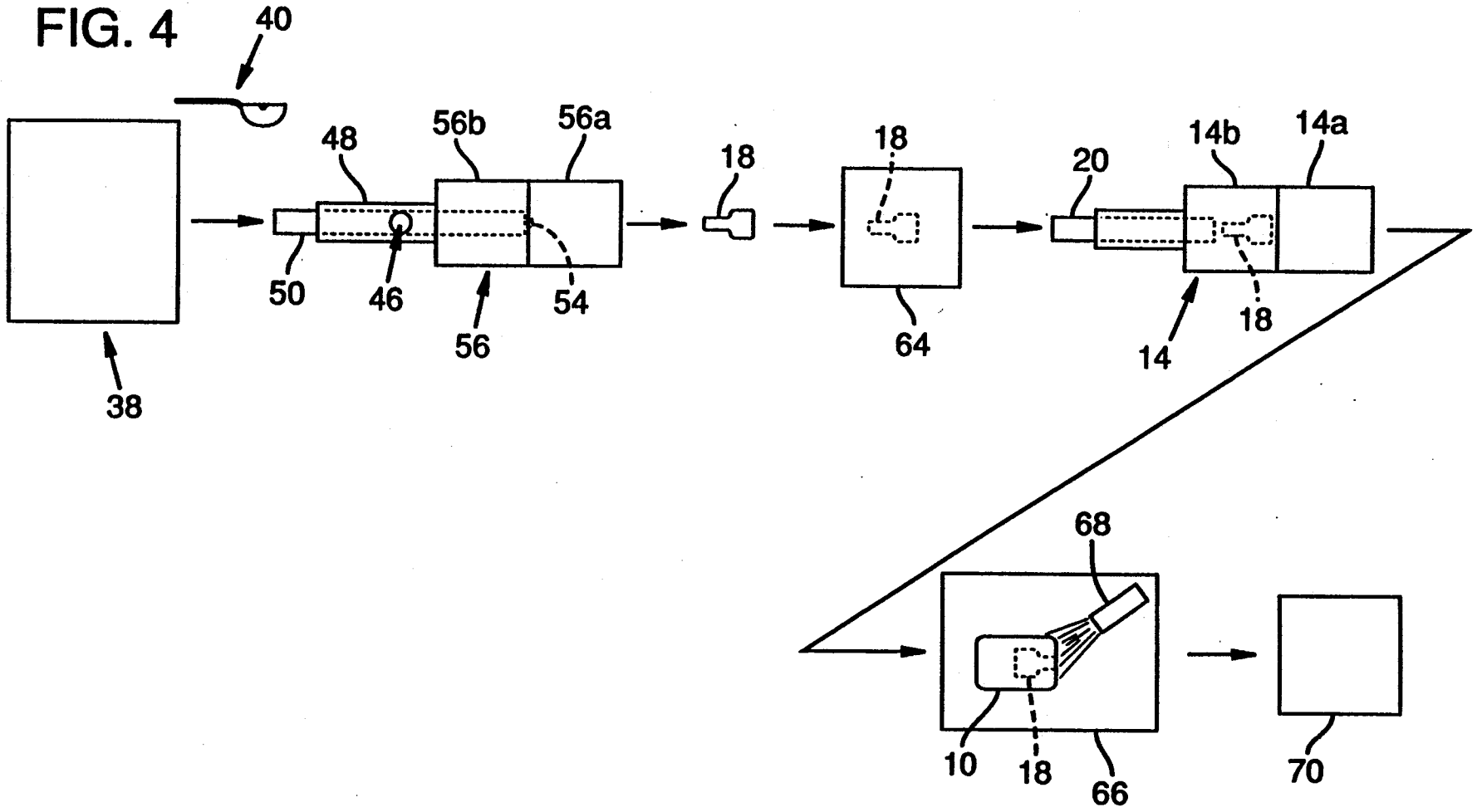
FIG. 4 schematically illustrates the overall system incorporating the machines of FIGS. 2 and 3.

Whereas the die casting process for the aluminum of FIG. 2 and the casting salt of FIG. 3 are independent operations, it is desirable to organize these processes into a common die casting production line as represented in FIG. 4.

With reference to FIG. 4, the casting salt 36 is first melted in the furnace 38. It is then injected into the core casting machine 56 where it is formed into a core 18. The core 18 is transferred to the holding oven 64 until it is inserted into the dies of the die casting machine 14. The die casting machine 14 injects a molten metal into its die cavity 16 to produce a casting 10 with the cast core 18 positioned within the casting as illustrated in FIG. 1. The core 18 is separated from the die casting machine 14 along with removal of the casting 10. The core 18 is removed from the casting 10 by simply dissolving and flushing the salt material from the casting at the core removal station 66.

Several factors must be considered in the molding and use of the salt cores.

It will be appreciated that the salt material utilized to form the cores is corrosive in nature and the equipment utilized in the process will be constructed and/or protected by corrosive resistant materials. The furnace 38, for example should be suitably lined with a corrosive resistant material, such as INCO 600 steel.

The salt has an affinity for moisture and thus must be handled in a manner that prevents the salt material from absorbing moisture.

The core casting machine 56 is of the type that utilizes split dies in the same manner as the well known conventional die casting machine illustrated in FIG. 2. The machine 56 utilizes a fixed die component 56*a* mounted on a fixed platen and a movable die component 56*b* mounted on a moveable platen. The fixed and moveable die components 56*a*, 56*b* when clamped together are configured to cooperatively form a mold having the desired cavity configuration 62 for molding a core 10 of the salt material 36.

The fixed and moveable dies are coated with a thin film of a releasing agent to insure that the salt material will release from the dies components 56*a*, 56*b* when they are separated. Typically, the components 56*a*, 56*b* will be sprayed or otherwise coated with the releasing agent followed by an air blow off to insure that any residual material is removed from the dies and that the components 56*a*, 56*b* are only finely coated with the releasing agent. This operation is performed prior to the first casting cycle and is repeated between casting cycles of the machine 56. Excess amounts of the releasing agent will tend to contaminate the core produced.

The shrink rate of the salt core is accurately calculated and taken into consideration in the design and shaping of the die cavity 62. The shrink rate for the salt material is greater than that of aluminum. The shrink rate is due in part to the solidification properties of the salt. The salt, which is an ionic compound crystallizes upon solidification. Also the density of the salt changes from about 0.069 to 0.077 pounds per cubic inch as it changes from a liquid to a solid. The overall shrink rate is on the order of 2 to 3 percent.

The salt material 36 is melted to a molten state in the furnace 38 and is maintained at a temperature of about 1320 degrees Fahrenheit. The molten salt 36 at this temperature is very fluid and it is not feasible to inject the molten salt in this fluid state into the die components 56*a*, 56*b* of the casting machine 56. The pressures of the casting process would force the liquid salt to escape from the dies, that is the dies would "spit" (blow) due to the fluidity of the molten salt. The highly fluid molten salt will leak between the juncture of the dies even though the dies are clamped together under high pressure. The molten salt 36 must therefore be cooled to make it more viscous.

The plunger 50 in the shot sleeve assembly of the machine 56 forces the molten salt material into the die cavity 62 as explained in FIG. 3. The plunger 50 is initially advanced a slow rate, referred to as the slow shot velocity, to force the salt material to the gate 54 leading into the die cavity 62. The gate 54 is the entrance through which the salt material 36 will flow into the cavity. The slow shot velocity is similar to that for aluminum, being in the range of 5 to 15 inches per second. The slow shot length, that is the distance that the plunger 50 moves, is determined by the volume of the salt material in the core 18 to be cast. When the salt material is advanced to the gate 54, the fast shot cycle is employed. The fast shot velocity is the velocity at which the plunger 50 advances to force the salt material through the gate to fill the cavity 62 with the molten casting salt material. The fast shot velocity is somewhat less than that of aluminum, it being on the order of 35 to 45 inches per second. The size or area of the gate 54 through which the material flows is also similar to the gate area for aluminum. (The gate area shape for aluminum is typically rectangular with the thickness much less than the width by multiples as large as 200). The actual shape of the gate 54 for the casting salt material is however quite different. The thickness of the gate for the casting salt material is much larger than that for aluminum. The relatively larger thickness of the gate and the reduced fast shot velocity (as compared to aluminum) provides for a solid front fill of the cavity 62 with the salt material. This type of fill is typically much smoother and less violent which benefits in the creating a smoother surface finish on the cast salt core and decreases the possibility of die "spitting" or "blowing". One of the factors that permits the solid front fill is the thermal conductivity of the salt material. The salt material has a much lower rate of thermal conductivity as compared to aluminum and therefore will lose heat at a much lower rate and thus solidify at a slower rate. This slower rate of heat loss permits a slower rate of fill.

Due to the fluidity of the molten salt, vents or overflows are not required for the escapement of air and gases. Natural venting is relied on for the escapement of air and gases. The internal porosity in the cast core created by gases entrapped within the core is not detrimental to the quality of the core surface finish or strength. The internal porosity is actually beneficial in that it will aid in the flushing process or removing the cast core from the subsequent part in which it is cast.

The pressure is not intensified at the end of the fast shot cycle, as is typical in casting a metal such as aluminum, but is held at the machine system pressure for a dwell time to allow the cast salt core 18 to solidify.

One of the properties inherent with the salt material is that as it cools, and changes from a liquid to a solid, a solidified shell is formed on the periphery of the salt body. This shell acts as an insulator which inhibits the loss of heat from the interior portion of the salt body and it is therefore necessary to minimize the formation of the insulating shell. The die components 56*a*, 56*b* of the core casting machine 56 are pre-heated and maintained at an elevated temperature, such as by circulating hot oil through porting 58, 60 in the dies. The dies are heated by the oil to a range of about 500 degrees Fahrenheit. The heating of the dies limits the formation of the insulating exterior shell which when allowed to form inhibits the cooling (and solidification) of the core interior. The cast core 18 is held in the heated dies under the system pressure for a dwell time to allow an even heat dissipation and even solidification of the cast salt core. It will be appreciated that the dwell time will vary depending on the volume and the configuration of the core to be cast. Typically dwell times ranging from 30 to 50 seconds are found to be adequate.

The cast salt core 18 is ejected from the core casting machine 56 after the dwell time has elapsed and is transferred to an oven 64 for further curing. The oven 64 is maintained at a temperature of about 600 degrees Fahrenheit. The core 18 is held at this temperature to avoid undue shrinkage and maintain the strength of and the surface finish of the core. It has been found that if the temperature of the core 100 is allowed to drop much below the holding temperature of the oven, the core may fracture when utilized in the dies of the die casting machine 50.

The cast core 18 of casting salt is transferred from the oven 64 and is positioned in the die components 14*a*, 14*b* of the die casting machine 14. The core 18 is arranged to be held in place in the die of the machine 14 by an interference fit. This may be accomplished by simple male-female type locators as illustrated in FIG. 2. As previously mentioned, the shrink rates are accurately calculated to ensure a precise fit.

The die components 14*a*, 14*b* of the machine 14 are clamped together, the cast core 18 being secured within the cavity 16 defined by the die components. The machine 14 is cycled to cast a part 10. The core 18 is entrained within the cast part 10 and is ejected with the casting 10.

The core 18 is removed from the casting 10 at the core removal station 66 by dissolving the core with high pressure hot water. The casting 10 is positioned in a suitable fixture and jets 68 of water are strategically aimed at the salt core 18. It is preferable to dissolve the salt core 18 while the casting 10 is still hot as this will reduce the time required to dissolve the core 18. The porosity of the core 18 aids in its removal. As the core 18 dissolves, the porosity will allow portions of the core material to break away in large pieces and these may be simply flushed out and away from the casting 10.

The casting salt 36 that is dissolved and removed from the casting may be reclaimed by a de-salination process 70. The salt material may thus be used again to produce other disposable cores.

Following are summary comparisons of the casting process for a typical aluminum product as compared to a process incorporating a casting salt core:

| Typical process sequence for Aluminum Casting: |
|---|
| Ingot aluminum melted in furnace |
| Molten aluminum ladled into shot sleeve |
| Machine cycled - plunger moves forward pushing molten metal into the die cast die at slow shot velocity |
| Metal reaches the gate of the casting - Fast shot velocity is triggered, spraying the metal throughout the cavities |
| The cavities are completely filled - the intensification pressure compacts the metal, forcing out excess gases |
| The casting is held for cooling (dwell) |
| The die is opened - the casting is ejected by several ejector pins |
| The casting is extracted from the die |
| The casting is trimmed, removing the gates, runners, overflows and vents from the parts |
| Comments: The extremely fast cooling of the molten aluminum necessitates fast cavity fill times. Any excess drop in temperature of the aluminum may result in improper cavity fills. |
| Process sequence for aluminum die casting with casting salt core: |
| Powdered salt melted in furnace lined with INCO 600 Steel |
| Core die preheated with hot oil to internal temperature of 500 F |
| Core die sprayed with die lube |
| Molten salt ladled into shot sleeve after desired temperature is achieved (1255 F) |
| Machine cycled - plunger moves forward pushing molten salt into the core die at slow shot velocity |
| Molten salt reaches the gate - fast shot velocity triggered, filling the cavity (solid front fill) |

-continued

| Typical process sequence for Aluminum Casting: |
|---|
| The cavities are completely filled - only system pressure of 1100 psi is applied to compact salt into cavities, forcing out some excess gases |
| The casting is held for cooling (long dwell) |
| The die is opened - the core is ejected by several ejector pins |
| The core is extracted from the die |
| The core is placed in the holding oven at the specified temperature |
| The core is installed into the aluminum die cast die |
| The aluminum casting process is cycled |
| The aluminum casting is placed in washout fixture - casting salt is flushed with hot, high pressure water |
| Casting salt is reclaimed through desalination process |

Those skilled in the art will recognize that modifications and variation may be made without departing from the true spirit and scope of the invention. The invention is therefore not to be limited to the embodiments described and illustrated but is to be determined from the appended claims.

What is claimed is:

1. A process for producing a core to be used for forming passages and cavities in a die casting process, said core being produced from a casting salt, said process comprising;

injecting molten die casting salt into a casting mold, and applying heat to the walls of the casting mold to prevent solidification of the core exterior prior to solidification of the core interior.

2. A process for providing a core to be used for forming passages and cavities in a die casting process, said core being produced from a casting salt, said process comprising;

maintaining a vat of molten casting salt at a temperature that exceeds the melting temperature of the casting salt, removing quantities of the molten casting salt to be transferred to a die casting shot sleeve, cooling the molten casting salt to its liquidus temperature and thereby increasing its viscosity, and transferring the casting salt in its cooled and liquified form to a die casting machine and injecting it into the die casting mold.

3. A process as defined in claim 1 including;

applying heat to the walls of the casting mold to prevent solidification of the core exterior prior to solidification of the core interior.

4. A process for producing a die cast metal product having an interior passage which process comprises;

producing a core as defined in claim 1, maintaining the temperature of the core above about 600 degrees, mounting the core to a die cast mold by press fitting it into a preformed depression in the mold, injecting a molten metal into the die cast mold and removing the cast metal product including the core contained in the internal passage from the mold, and removing the core from the cast metal product by applying liquid to convert the core material to solution and thereby washing the core out of the product.

5. A process as defined in claim 4 which includes reclaiming the solution of liquid and casting salt, desalinating the solution to convert the salt material back to solid form and for recycling thereof.

* * * * *

UNITED STATES PATENT AND TRADEMARK OFFICE

CERTIFICATE OF CORRECTION

PATENT NO. : 5,303,761
DATED : April 19, 1994
INVENTOR(S) : Flessner, et. al.

It is certified that error appears in the above-indentified patent and that said Letters Patent is hereby corrected as shown below:

Column 8, line 46, change "Claim 1" to --Claim 2--.

Column 8, line 52, change "Claim 1" to --Claim 2---.

Signed and Sealed this

Ninth Day of August, 1994

*Attest:*

Bruce Lehman

BRUCE LEHMAN

*Attesting Officer*

*Commissioner of Patents and Trademarks*